United States Patent [19]

Ershig

[11] Patent Number: 4,775,074

[45] Date of Patent: Oct. 4, 1988

[54] MECHANICAL LOCK FOR VESSELS

[75] Inventor: A. Herbert Ershig, Bellingham, Wash.

[73] Assignee: Ershigs, Inc., Bellingham, Wash.

[21] Appl. No.: 65,582

[22] Filed: Jun. 23, 1987

Related U.S. Application Data

[63] Continuation-in-part of Ser. No. 893,693, Aug. 6, 1986, abandoned.

[51] Int. Cl.[4] ..... B65D 45/28

[52] U.S. Cl. ..... 220/323; 220/315; 215/279

[58] Field of Search ..... 215/279; 220/323, 234, 220/237, 238, 243, 245, 246, 251, 315, 319, 359

[56] References Cited

U.S. PATENT DOCUMENTS

| | | | |
|---|---|---|---|
| 3,820,682 | 6/1974 | Davella | 220/315 |
| 4,102,474 | 7/1978 | Platts | 220/323 |
| 4,303,177 | 12/1981 | Amtmann | 220/323 |
| 4,387,740 | 6/1983 | Vanzant | 220/323 X |
| 4,489,850 | 12/1984 | Reneau | 220/323 |

FOREIGN PATENT DOCUMENTS

| | | | |
|---|---|---|---|
| 1269514 | 1/1961 | France | 220/315 |

*Primary Examiner*—Stephen Marcus
*Assistant Examiner*—Nova Stucker
*Attorney, Agent, or Firm*—Graybeal, Jensen & Puntigam

[57] ABSTRACT

A segmented mechanical lock for a container including arcuate segments 12, 14, 16 having upstanding pins 18, pivot ring 20 having tangential slots 22 overlies the segments and upon rotary motion moves them outwardly into a groove 48 locking lid 6 in position in vessel 4.

1 Claim, 3 Drawing Sheets

FIG. 5
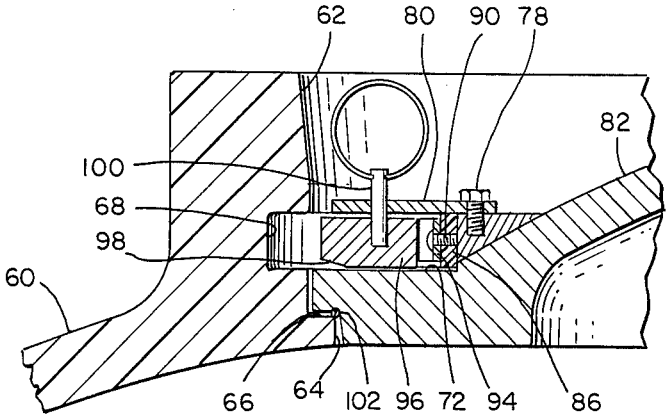
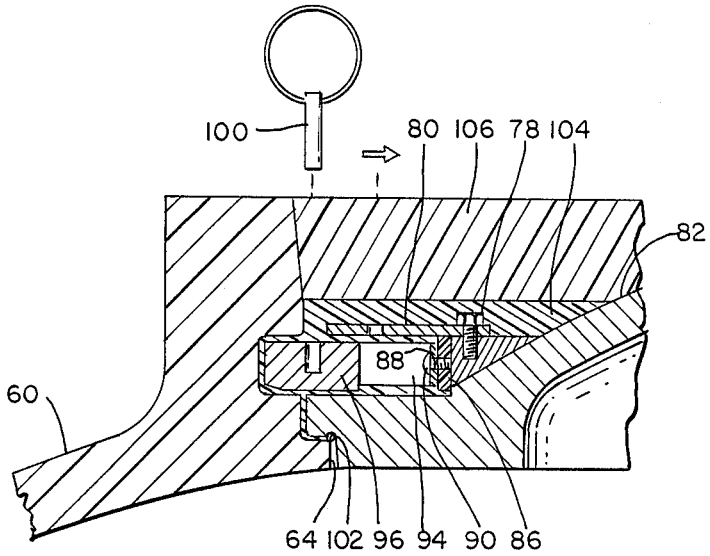
FIG. 6

MECHANICAL LOCK FOR VESSELS

This application is a continuation-in-part of U.S. patent application Ser. No. 893,693 filed Aug. 6, 1986 now abandoned.

TECHNICAL FIELD

This invention relates to a mechanically locked, plug-type cover for permanently sealing waste containers when used in conjunction with a chemical seal and more particularly to the mechanism for effecting the mechanical lock and the method of sealing said container.

BACKGROUND ART

A conventional method of disposing of waste material, which is toxic, radioactive, or otherwise harmful is to place said material in an impervious container seal it and bury it at a remote location.

Fiberglass reinforced plastic tanks have been found to be satisfactory for certain radioactive material as well as other toxic material. However, because of the difficulty in achieving a seal around the filling opening which would withstand the required stress and drop tests, the openings have necessarily been small.

Whereas the restricted opening size has not proven to be a great detriment in many applications, there has been expressed a desire to have an opening which is larger in size for accepting a greater variety of materials as well as allowing a more rapid filling of the container.

DISCLOSURE OF THE INVENTION

With the above noted prior art and problems in mind, it is an object of the present invention to provide a storage container having a mechanically locked and chemically sealed cover of a non-corrosive chemically resistant material.

It is yet another object of the present invention to provide a method of mechanically and chemically sealing a fiberglass reinforced plastic vessel.

A further object of the present invention is to provide a vessel and seal of sufficient integrity such that the vessel adequately contains the material to be disposed of by withstanding the pressure of burial at a specified depth.

Yet another object of the present invention is to provide a mechanical locking mechanism which is simple of structure, of a nondegrading material and yet reliable and simple to operate.

Still a further object of the present invention is to provide a mechanical lock for a vessel wherein the locking mechanism extends about the majority of the periphery of the cap to be sealed distributing any stress thereon around substantially the entire periphery.

BRIEF DESCRIPTION OF THE DRAWINGS

FIG. 5 is a partial sectional view of the cap of FIG. 4 with the cap in place prior to locking.

FIG. 6 is a partial sectional view of the cap of FIG. 4 in a locked and sealed condition.

BEST MODE FOR CARRYING OUT THE INVENTION

Figure 1:
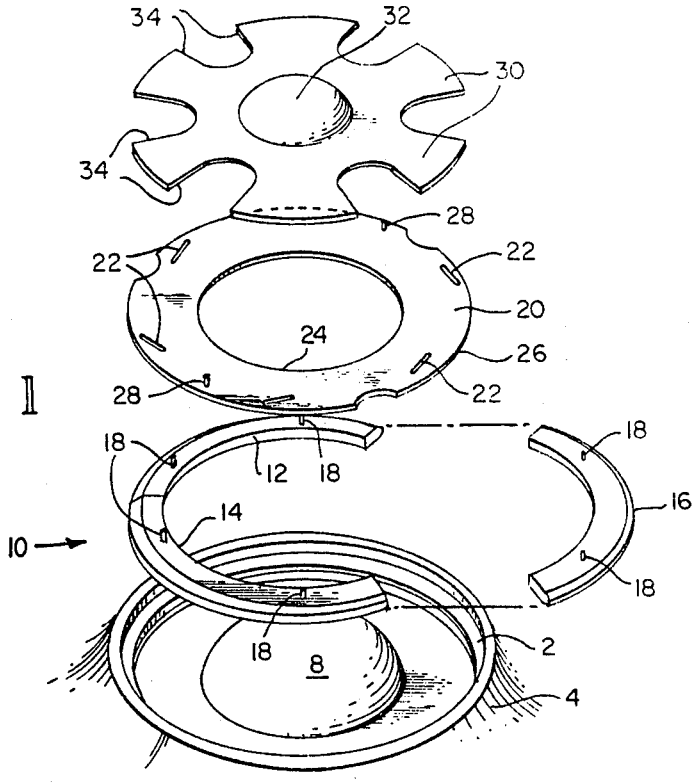
FIG. 1 is an exploded view of the mechanically locked, sealing cap of the present invention.

As seen in FIG. 1, the neck 2 of the waste holding container 4 is shown with the plug cap 6, having an upwardly projecting dome 8, in place. It is to be understood that the cap could be of various shapes and the configuration is not critical. As seen in the exploded view is the segmented locking ring 10 having, in the preferred embodiment, three segments 12, 14, 16 each of which has a pair of upstanding pins 18. Pins 18 cooperatively interact with pivot ring 20 having a plurality of slots 22 each designed to mate with a respective pin 18. Each of the slots is tangential to a circle intermediate the inner edge 24 and outer edge 26 of pivot ring 20 and extend in the same direction. When pivot ring 20 is placed in position over pins 18 with inner edge 24 surrounding dome 8 of plug 6 and rotated by cover plate 30 described hereinafter in the appropriate direction segments 12, 14 and 16 move outwardly. A pair of pins 28 project upwardly from pivot ring 20 to interact with a spanner wrench or other appropriate tool at the time of locking the lid, i.e. expanding the locking ring.

Cover plate 30 is provided with a central dome 32 which is closely configured to ride on dome 8 of the cover 6 and a plurality of inwardly directed scalloped-type cuts 34 to accommodate upwardly extending pins 28 and any extension of pins 18 beyond the upper surface of pivot ring 20.

Figure 2:
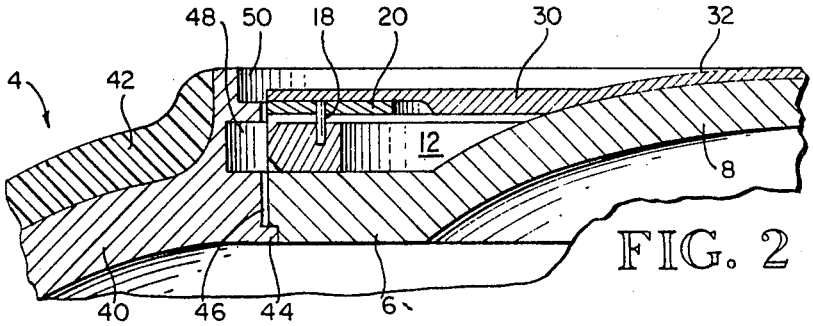
FIG. 2 is a sectional view through the cap, in position in the mouth of the container, in the unlocked position.

Referring now to FIG. 2, the relationship between the container 4 and the cover may more easily be seen. As seen in this view, the main body of the container 4 is a fiberglass reinforced plastic shell 40 which may be covered with a shock absorbing bumper material 42. The fiberglass reinforced plastic shell 40 includes an inwardly extending lip 44 upon which the lid 6 is seated. A seal can be affected between 44 and the outwardly extending congrous lip 46 of the lid by either an O-ring gasket assembly or alternatively a elastomer bead placed upon the lid prior to the locating of the lid itself. An annular groove 48 accommodates the locking ring segments 12, 14 and 16 and an upwardly extending edge 50 accommodates the sealing resin as explained hereinafter.

Figure 3:
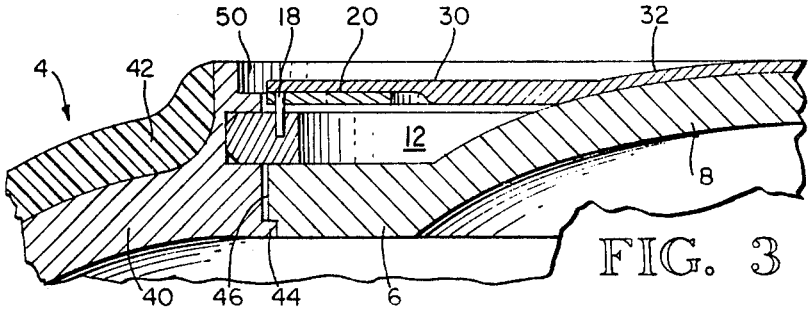
FIG. 3 is a sectional view of the cap, in position in the mouth of the vessel, in the locked condition prior to the chemical sealing operation.

As seen in FIG. 2, the locking ring segment 16 along with segments 12 and 14 are in their initial unlocked position; and as seen in FIG. 3, they have been moved outwardly to their locking position, in the groove 48, mechanically locking the lid 6 to the tank 4.

In operation, when it is desired to seal the first embodiment tank, an elastomer bead is placed about the lower lip of the lid 6 and it is placed within the tank sealing the lid to the tank to prevent sealant from entering the tank during the succeeding steps. As an alternate, as stated above, an O-ring gasket could be placed to perform the same function.

Following the placement of the lid on the ledge in the tank a sealant is poured along the edges of the lid sealing all of the openings and providing a lubricant for the locking ring segments 12, 14 and 16. Once the sealant is in position, cover plate 30 is rotated, forcing locking rings 12, 14 and 16 to expand outwardly to that position as shown in FIG. 3. Following the movement of the locking ring segments outwardly the entire upper portion of the tank top up to the top of ledge 50 is filled with a filled resin sealant, and adhesive which gives the lid additional strength and improves the seal.

Figure 4:
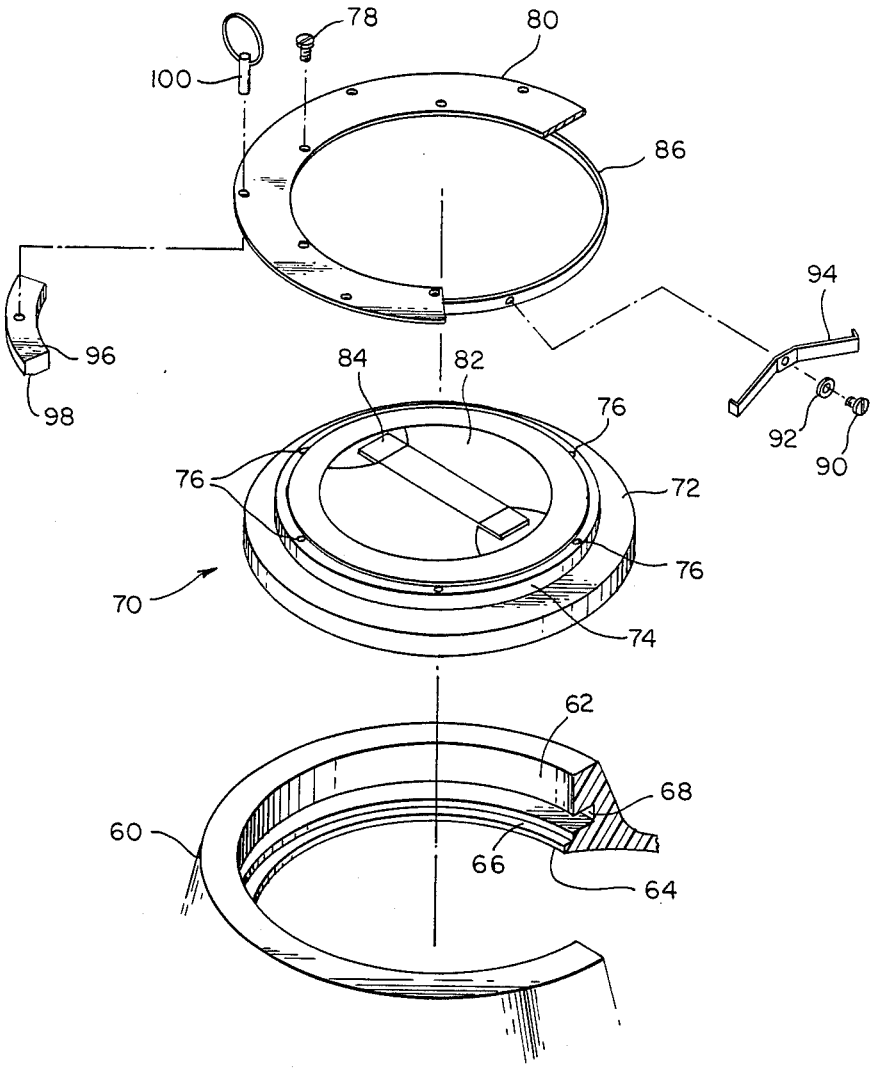
FIG. 4 is an exploded view of a second embodiment of a mechanically locked sealing cap.

Reference is now had to FIG. 4 where the vessel 60 having an upwardly facing opening 62 is shown. It is to be noted that the inner portion of the opening or neck 62 includes a lowermost inwardly projecting ledge 64 having a relatively flat upward face 66. Spaced slightly above the flat face 66 is a radially outwardly extending groove 68 to receive the mechanical locking mechanism as described hereinafter. The plug or cap generally designated as 70 includes a flat circumferential outer surface (seen best in FIGS. 5 and 6) of a diameter such that it will rest upon the flat surface 66 when in position. Lid 70 also includes a flat circumferential upper surface 72 which surrounds an upwardly extending cylindrical surface 74 for purposes to be hereinafter described. Upon the upper surface of upwardly extending cylindrical element 74 are a plurality of openings 76 which are threaded to receive fastening member 78 securing flat disk 80 in a position overlapping but spaced from surface 72. The remainder of the main body portion of the plug member 70 includes a generally flat upper surface 82 having secured thereto a handle or lifting member 84.

Flat disk 80 has secured to the lower portion thereof intermediate its inner and outer radius, a downwardly extending cylindrical member 86 and a plurality of radially extending threaded openings 88 adapted to receive threaded fastening members 90 which in conjunction with washers 92 secure leaf springs 94 in position. There are six springs 94 distributed about the circumference of cylinder member 86.

Six arcuate members 96 having a chamfered lower surface 98 are located resting upon flat surface 72, each of which compreses a spring 94 and are held in position in the unlocked position by pin member 100.

Referring now to FIG. 5 the plug type closure can be seen in the unlocked position i.e. pin 100 has not been removed and the elements are denoted by the same numerals as in FIG. 4 for clarity.

As seen in FIG. 5, the plug-like cover is in place in preparation for sealing. It is to be noted that there is a gasket 102 sealing the space between the lid and the container itself.

As seen in FIG. 6, the plug lid is sealed. The sealing is accomplished through the process of first adding a liquid, combination sealant/lubricant, 104 pulling pins 100, allowing spring 94 to expand forcing the locking element 96 outwardly into the groove 68. The sealant lubricant is allowed to cure thus sealing the entire space. A second resin 106 is then added as a protective cover for the entire sealed vessel.

Thus as can be seen the present invention contemplates the utilization of a simple mechanical structure backed by a chemical seal to provide a plug type sealed container for harmful chemicals or the like.

Thus as can be seen the present invention teaches the concept of a sealed cover for waste material wherein the integrity of the tank is not compromised. The sealed mechanical link between the tank and the cover results in an integral tank/cover unit.

I claim:

1. A sealed container for use with toxic or otherwise harmful material, said container including a mouth having an upwardly projecting circumferential ridge, said ridge having an inwardly open circumferential groove and an inwardly projecting circumferential lip, a primary closure member including a flat circumferential upper surface adjacent the outer edge thereof and a circumferential radially inward step at its lower surface, said step including downwardly open notch, a circumferential seal received in said downwardly open notch, a substantially flat unbroken ring member secured to the primary closure member such that it overlies but is vertically spaced from the flat circumferential upper surface, a segmented broken ring slideably received between the unbroken ring member and the upper surface of the primary closure member, said segmented ring member of a size to slide into the groove in the mouth ridge while remaining captured between the primary closure member and the unbroken ring, means selectively urging the segmented ring to the locked or expanded position, a first combination lubricant/sealant filling the space from the circumferential seal to above the unbroken ring to facilitate the expansion of the segmented ring and, upon setting up, seal the container, a second sealant filling the space to the top of the circumferential ridge surrounding the mouth.

* * * * *